United States Patent [19]

Inouye et al.

[11] 4,152,038

[45] May 1, 1979

[54] ELECTRICAL CONNECTOR

[75] Inventors: Hiromasa Inouye, Musashino; Matsuo Kato, Tokyo, both of Japan

[73] Assignee: Bunker Ramo Corporation, Oak Brook, Ill.

[21] Appl. No.: 883,642

[22] Filed: Mar. 6, 1978

[30] Foreign Application Priority Data

Mar. 23, 1977 [JP] Japan ..... 52-34256[U]

[51] Int. Cl.[2] ..... H01R 13/62

[52] U.S. Cl. ..... 339/75 M; 339/91 R; 339/176 MP

[58] Field of Search ..... 339/75 MP, 91 R, 74 R, 339/74 ML, 75 M, 176 MP; 361/399, 413, 415

[56] References Cited

U.S. PATENT DOCUMENTS

| | | | |
|---|---|---|---|
| 2,714,195 | 7/1955 | Beatty | 339/75 M |
| 3,495,206 | 2/1970 | Pfister | 339/75 X |
| 3,670,288 | 6/1972 | Evans | 339/176 MP X |
| 3,784,954 | 1/1974 | Grimm et al. | 339/75 MP X |
| 4,045,109 | 8/1977 | Langenbach et al. | 339/91 R X |

*Primary Examiner*—Roy Lake
*Assistant Examiner*—E. F. Desmond
*Attorney, Agent, or Firm*—William Lohff; F. M. Arbuckle

[57] ABSTRACT

An apparatus for facilitating the coupling and uncoupling of electrical connectors. The apparatus includes at least one rack gear on the body of a first of a pair of electrical connectors and a pinion member on the other, engageable with the rack and having an actuating lever for rotating the pinion member. As the lever is moved in a first direction, the pinion rotates and engages the rack, pulling the two connectors together. When the lever is moved in the other direction, the connectors are pulled apart.

8 Claims, 6 Drawing Figures

ELECTRICAL CONNECTOR

The present invention relates to the field of electrical connectors, and more particularly to the field of apparatus for facilitating the coupling and uncoupling of electrical connectors.

Electrical connectors are used in almost every modern day electronic and electrical device. The use of electrical connectors facilitates service of the device by permitting removal of individual components of the device for repair or replacement. Due to the trend of miniaturization in the electronics industry, these connectors are frequently very small and often must be positioned in cramped areas, making the coupling and uncoupling of the connectors very difficult.

In order to assure proper electrical connection, it is necessary that the conductors of the mating connectors be biased towards each other with a certain minimum contact pressure. This pressure causes a certain amount of friction when the two connectors are coupled or uncoupled. With the modern multi-conductor connectors containing a large number of individual contacts, this frictional force becomes very significant.

Due to the friction and the cramped quarters, it is often very difficult to couple or uncouple electrical connectors in complicated electronic devices. Additionally, one or both of the connectors is often supported by a relatively fragile circuit board which is not capable of withstanding the force required to couple or uncouple the connector. Therefore, very expensive electronic equipment is often damaged by improper or careless connection of the connectors.

Prior art connectors include various handles to facilitate grasping of connectors in hard to get to places, but a need exists for a means to decrease the amount of force applied to a connector mounting during the connection process, without decreasing the contact pressure of the individual contacts.

It is therefore an object of the present invention to provide an apparatus which facilitates the coupling and uncoupling of electrical connectors by substantially reducing the force applied to the bodies of the connectors during the connection process.

It is a further object of the present invention to provide an apparatus which reduces the connection forces by providing a mechanical advantage in a linkage for causing relative movement of the two connectors.

It is a still further object of the present invention to provide an apparatus in which relative movement between two connectors is caused by the interaction of a pinion member mounted on one of the connectors and a rack gear mounted on the other of the connectors.

It is an additional object of the present invention to provide an apparatus which includes a latch mechanism for securing the two connectors in a mated relationship.

The present invention satisfies these objects by providing an apparatus comprising a rack gear mounted on one of the electrical connectors and a pinion member rotatably mounted on the other of the connectors and engageable with the rack to cause relative movement of the electrical connectors toward and away from each other. The pinion member also includes an operating lever for rotating the pinion. The length of the lever supplies a mechanical advantage in the movement of the connectors, thereby reducing the forces required to couple and uncouple the connectors.

Preferably, racks and engaging pinion members are mounted on either side of the connectors and are operated simultaneously to assure that the connectors do not bind and that the contacts are not damaged.

Additionally, the operating levers may include latches for securing the connectors in a mated relationship.

The present invention will now be described in detail, with reference to the accompanying drawings representing preferred embodiments of the apparatus for coupling and uncoupling mating electrical connectors in accordance with the invention. In the drawings.

Figure 3A:
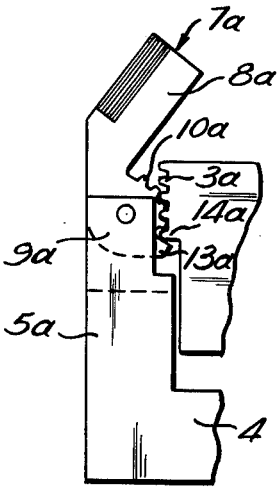

FIGS. 3A, B and C are detailed front elevational views of a portion of the electrical connectors shown in FIG. 1, showing alternate embodiments of the pinion member of the present invention.

Figure 1A:
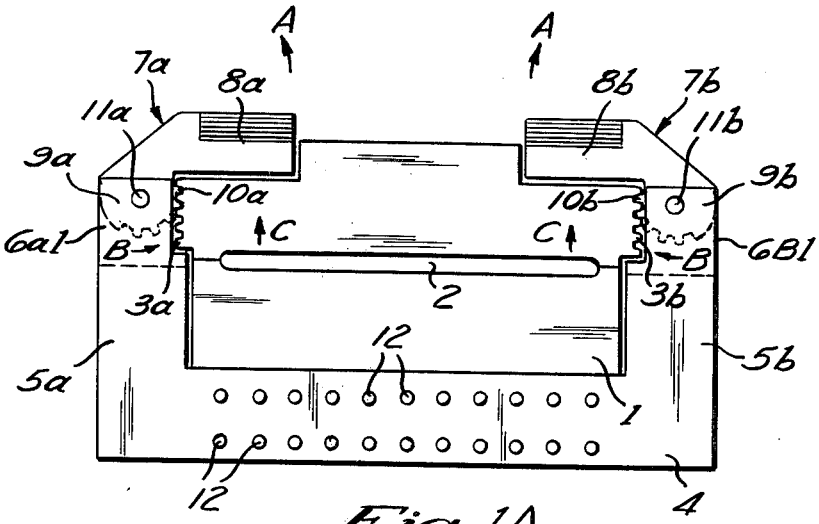
FIG. 1A is a front elevational view of two mated electrical connectors including the apparatus of the present invention.

FIGS. 1A and B show electrical connector 1 having cable passageway 2 and end racks 3*a* and 3*b*. The connector 1 is mated with electrical connector 4 having connector body side members 5*a* and 5*b* extending along respective sides of the connector 1. The side members 5*a* include supporting arms 6*a*1, 6*b*1, and 6*b*2. Pinion members 7*a* and 7*b* are pivotally mounted between the supporting arms by means of pivots 11*a* and 11*b*, respectively. Each of pinion members includes an operating lever portion 8*a* and 8*b*, and a pinion portion 9*a* and 9*b*, having gear teeth 10*a* and 10*b*, respectively. Connector 4 shown in the figures includes terminals 12 for connection to a printed circuit board. However, it should be realized that the apparatus of the present invention can be used with any type of electrical connector, and with smaller connectors, one rack and one pinion member is sufficient to easily couple and uncouple the connectors.

Figure 1B:
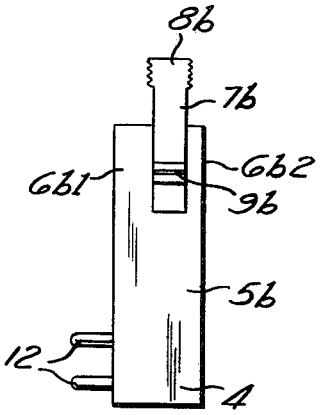
FIG. 1B is a side elevational view of the electrical connectors shown in FIG. 1A.

Connectors 1 and 4 are completely mated in FIGS. 1A and 1B. In order to uncouple the connectors, levers 8*a* and 8*b* are moved in the direction of the arrows A, causing rotation of the pinion members 7*a* and 7*b* about pivot points 11*a* and 11*b*, respectively, in the direction of the arrows B. Since the teeth 10*a* and 10*b* engage the teeth of the racks 3*a* and 3*b*, respectively, the connector 1 is caused to move in the direction of the arrows C.

According to the embodiment of FIGS. 1A and 1B, the operating levers 8*a* and 8*b* extend tangentially from pinion portions 9*a* and 9*b*, respectively. The operating levers are preferably arranged such that the levers extend perpendicular to the direction of coupling C when the connectors are completely mated.

Operating levers 8*a* and 8*b* may advantageously include roughened gripping areas as best shown in FIG. 1B.

Figure 2:
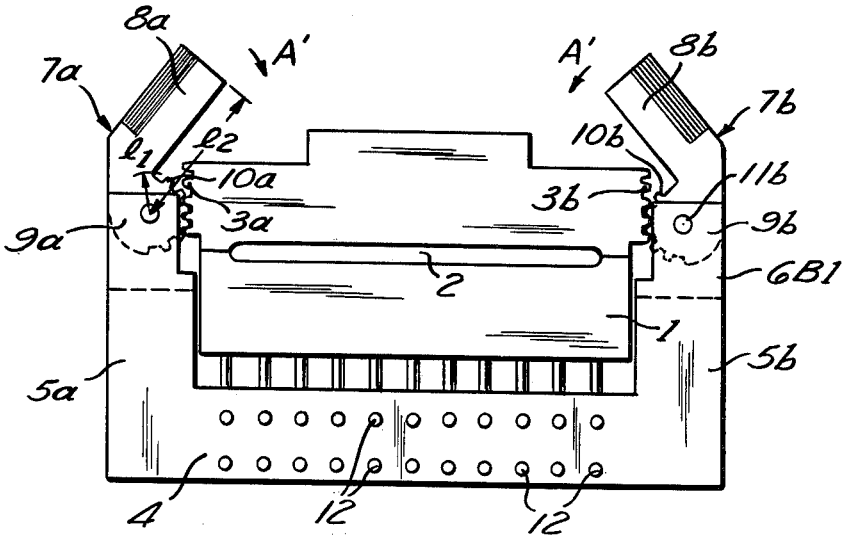
FIG. 2 is a front elevational view of the electrical connectors shown in FIG. 1 in a partially disconnected relationship.

FIG. 2 shows the connectors 1 and 4 in a partially uncoupled configuration. In order to completely mate the connectors, only a small force is required on the operating levers 8*a* and 8*b* in the direction of the arrows A' to cause the connectors to move together.

Since the radius of the pinion portion 9*a* is $l_1$, and the length of the operating lever from the pivot to its remote end is the much larger distance $l_2$, a mechanical advantage equal to $l_2/l_1$ is gained by the apparatus of the present invention and the force required to couple the connectors is reduced by this ratio. Due to the small amount of force required to move the operating levers, they can easily be manipulated, even if they are accessible only with one's fingertips. Furthermore, the force applied to the mounting of connector 4, i.e. a printed circuit board, is equal only to the sum of the forces applied to the operating levers, which is only a fraction of the coupling and uncoupling forces.

FIG. 3A shows an alternate embodiment of the pinion portion 9*a* and pinion 7*a*. In this embodiment, an enlarged first tooth 13*a* of the pinion portion 9*a* cooperates with a portion 14*a* of the connector 1 in order to assure proper meshing of the gear teeth 10*a* with the rack 3*a*.

Figure 3B:
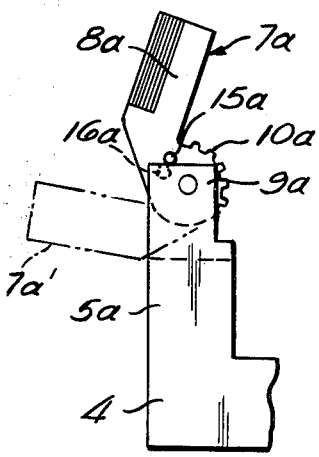

FIG. 3B shows a further alternate embodiment of the apparatus of the present invention having stop means 15*a* which limits the rotational movement of the pinion member 7*a* to prevent it from rotating to the position 7*a'* shown in phantom in the drawing. Catch 16*a* may be included in support 6*a*1 to hold the pinion member 7*a* in the open position until a connector 1 is to be mated with the connector 4. The catch 16*a* resiliently holds the stop 15*a* to prevent the pinion member from rotating into the closed position which would obstruct insertion of a connector 1.

Figure 3C:
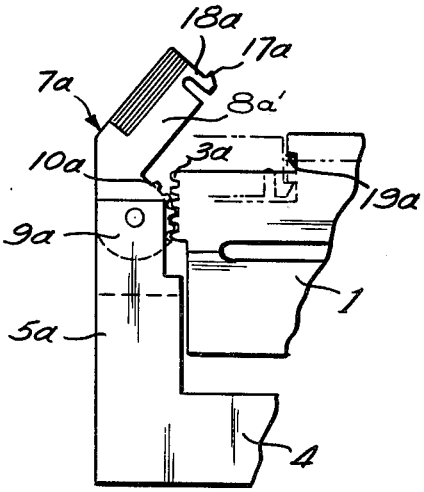

FIG. 3C shows a further alternative embodiment of operating lever 8*a'*. According to this embodiment, hook means 17*a* is provided on the end of resilient finger 18*a* for engaging cooperating lip 19*a* of connector 1. When operating arm 8*a'* is in the position shown in phantom in FIG. 3C, the hook means 17*a* releasably holds the operating lever against rotation. Since the gear teeth 10*a* are still in engagement with the rack 3*a*, the connector 1 cannot be uncoupled from the connector 4 while the hook 17*a* is engaged in the stop 19*a*. Accordingly, the connectors are secured against an advertent disconnection.

Due to the mechanical advantage provided by the pinion member, the force applied to the hook means 17*a* is only a fraction of the force applied to the connectors 1 and 4. Therefore, the hook means 17*a* can be designed to resist a tremendous uncoupling force supplied to the connectors, while at the same time being simple to disengage from the stop 19*a* by a relatively small force on the operating lever 8*a'*.

From the foregoing, it can be readily realized that this invention can assume various embodiments. Thus, it is to be understood that the invention is not limited to the specific embodiments described herein, but is to be limited only by the appended claims.

The embodiments of the invention in which an exclusive property or privilege is claimed are defined as follows:

1. An apparatus for coupling and uncoupling two mating electrical connectors, each of which include a connector body, said apparatus comprising: at least one rack gear means on the body of one of said electrical connectors; and at least one pinion means pivotally mounted on the body of the other of said connectors for engaging said rack means; said pinion means including operating lever means for rotating said pinion; whereby rotation of said pinion means in a first direction causes relative movement of said two electrical connectors toward each other and into a mating relationship, and rotation of said pinion means in a direction opposite to said first direction causes relative movement of said two connectors away from each other.

2. The apparatus as claimed in claim 1, wherein said pinion means is an integral element having a generally circular portion having a plurality of gear teeth circumferentially disposed thereon and a tangentially extending arm portion forming said operating lever means.

3. The apparatus as claimed in claim 2, wherein a first of said teeth, remote from said arm includes aligning means for cooperating with the body of said one connector to mesh said teeth with said rack.

4. The apparatus as claimed in claim 2, wherein said arm is positioned with respect to said teeth such that when said connectors are mated, said arm extends perpendicular to the direction of said relative movement.

5. The apparatus as claimed in claim 1, further including means for latching said pinion means to prevent rotation thereof when said connectors are in a mated relationship, thereby securing said connectors in said mated relationship.

6. The apparatus as claimed in claim 5, wherein said latching means includes hook means on said lever means and cooperating hook-engaging means on the body of one of said connectors.

7. The apparatus as claimed in claim 1, further comprising stop means for releasably holding said pinion means in a predetermined position when said two connectors are separated, whereby said pinion engages said rack with a predetermined orientation when said two connectors are brought together.

8. The apparatus as claimed in claim 1, wherein one of said rack means is located on either side of said one electrical connector, and a respective pinion means is located on either side of said other connector.

* * * * *